United States Patent [19]

Brown

[11] 4,047,492

[45] Sept. 13, 1977

[54] SAILING DEVICE

[76] Inventor: Marlene J. Brown, 226 Pequot Ave., Mystic, Conn. 06355

[21] Appl. No.: 676,053

[22] Filed: Apr. 12, 1976

[51] Int. Cl.[2] ..... B63B 35/00

[52] U.S. Cl. ..... 114/39; 9/311

[58] Field of Search ..... 9/311, 312, 9, 329; 114/39, 89, 90; 116/173; 272/1 B

[56] References Cited

U.S. PATENT DOCUMENTS

| | | | |
|---|---|---|---|
| 859,233 | 7/1907 | Lane | 116/173 |
| 1,625,579 | 4/1927 | Walters | 114/39 |
| 1,634,932 | 7/1927 | Cook | 114/89 |
| 2,947,557 | 8/1960 | Schwab et al. | 116/173 |
| 3,037,220 | 6/1962 | Jantzen | 9/312 |
| 3,057,316 | 10/1962 | Hansen | 114/39 |
| 3,771,181 | 11/1973 | Dansereau | 9/329 |
| 3,902,208 | 9/1975 | Dansereau | 9/311 |

FOREIGN PATENT DOCUMENTS

| | | | |
|---|---|---|---|
| 1,436,594 | 11/1966 | France | 114/39 |
| 458,068 | 12/1936 | United Kingdom | 114/39 |

*Primary Examiner*—Trygve M. Blix
*Assistant Examiner*—Jesus D. Sotelo
*Attorney, Agent, or Firm*—Albert W. Hilburger

[57] ABSTRACT

Portable apparatus for propelling a person floating in water. A person floating naturally face-up in the water can position herself over a floatable support member positioned in such a manner that a mast mounted on the support member extends upwardly between her legs. To provide propulsion, a sail is attached to the mast such that its position in azimuth can be controlled by the person. Whenever desired, the sail can be removed, the mast telescoped to a shortened length, and the support member folded enabling the apparatus to be easily transportable.

3 Claims, 6 Drawing Figures

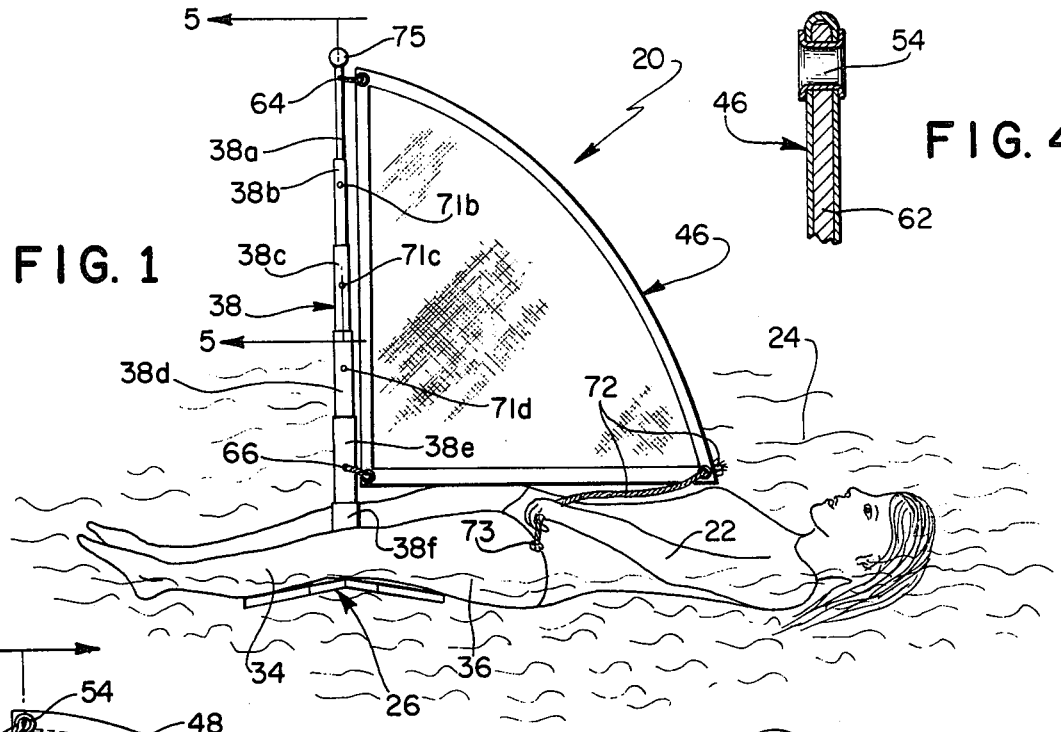
FIG. 1
FIG. 4
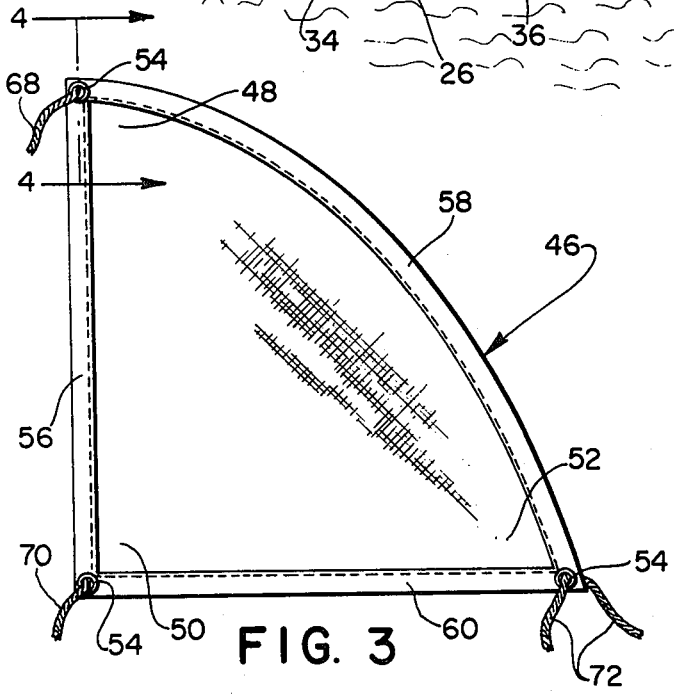
FIG. 3
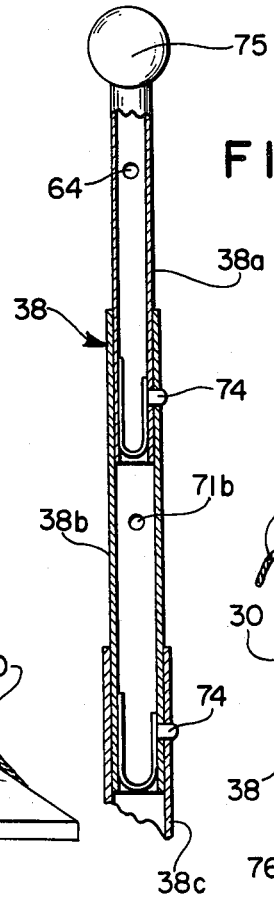
FIG. 5
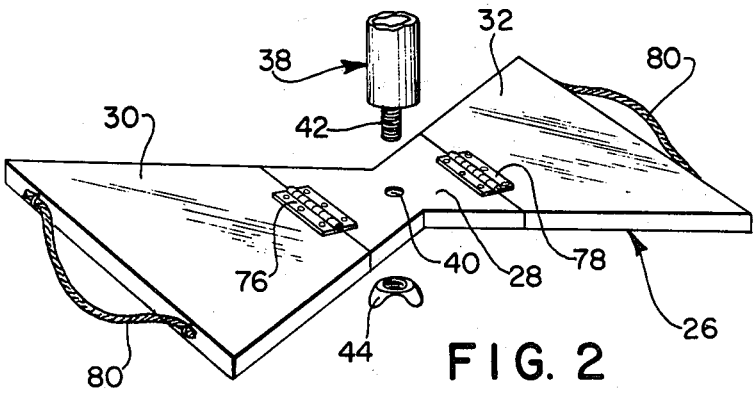
FIG. 2
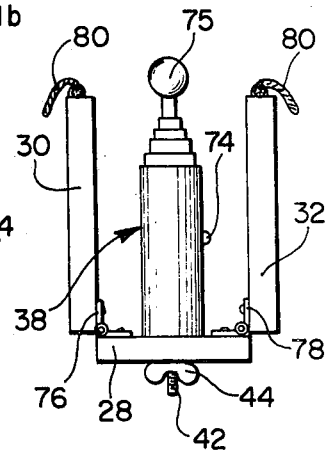
FIG. 6

SAILING DEVICE

BACKGROUND OF THE INVENTION

The present invention relates generally to improved recreational apparatus, and, specifically, to a new and improved device utilizing a sail for propelling a floating person through the water.

There have been attempts in the past to propel a person through the water by means of sail devices. However, these were not particularly satisfactory devices by reason of the fact that they are generally bulky or heavy or difficult to control. Such known prior devices utilized floats or life preservers presumably to add to the buoyancy of the user and it was common practice to strap such floats or life preservers to the body of the user in order to permit them to achieve their maximum benefit. However, it could be said that such devices did not achieve a high degree of success in the market place, presumably because of their bulk and complexity.

SUMMARY OF THE INVENTION

The present invention is considered to be a distinct improvement over such known devices. To this end, the present disclosure relates to portable apparatus for propelling a person capable of floating in the water without artificial assistance. A floatable support member with minimal excess buoyancy is positioned beneath the person's legs and a mast is mounted on the support member so as to extend upwardly between the person's legs. In order to provide propulsion, a sail is attached to the mast in such a manner that its position in azimuth can be controlled by the person. Whenever desired, the sail can be removed, the mast telescoped to a shortened length, and the support member folded enabling the apparatus to be easily transportable.

The invention is of light yet sturdy construction, and because of its portable nature, can easily accompany an individual without undue strain. Furthermore, as a distinct safety feature, the apparatus is unattached to the person, thereby permitting freedom of body movement in all directions.

Although a person may wish to use a life preserver in combination with the invention, the device is equally capable of being used by a person who wishes to float unencumbered.

While the invention can be used for recreational activity, it is also most appropriate for teaching the techniques of sailing on a most basic level.

Additionally, the simplicity of the invention's design results in a construction which can be easily and inexpensively produced and it follows that upkeep and maintenance would also be at a minimum.

It is to be understood that both the foregoing general description and the following detailed description are exemplary and explanatory but are not restrictive of the invention.

The accompanying drawings which are incorporated in, and constitute a part of this invention, illustrate a preferred embodiment of the invention, and together with the description, serve to explain the principles of the invention.

IN THE DRAWINGS

FIG. 1 is a perspective view of the invention being used by a floating person;

FIG. 2 is a perspective view illustrating certain elements of the invention in an exploded fashion;

FIG. 3 is a side elevation view of the sail utilized by the invention;

FIG. 4 is a detail cross-section view of another element of the invention, taken along line 4—4 of FIG. 3;

FIG. 5 is a cross-section view of an element of the invention, taken along line 5—5 in FIG. 1; and FIG. 6 is a side elevation view illustrating the invention in its folded position.

DESCRIPTION OF THE PREFERRED EMBODIMENT

Refer now to the drawings, and initially to FIG. 1. In FIG. 1, the invention is depicted as a sailing device generally designated by reference numeral 20 being used by a person 22 floating on a body of water 24. It is noteworthy that the person 22 is not attached or secured to the sailing device 20 in any fashion but is merely positioned above a support member 26 which itself is floatable but which may add little or no buoyancy to the person. Although the person may utilize other buoyant expedients such as life preservers, cushions, and the like in combination with the sailing device 20, such expedients are not a necessary part of the invention and, indeed, may be detrimental to its operation. Thus, the person has complete freedom of movement in substantially all directions and can be readily disassociated with the invention in a rapid fashion should that be necessary for purposes of safety or convenience.

As more clearly seen in FIG. 2, the support member 26 is illustrated as being generally in the shape of a bow tie. This shape is merely one of many possible shapes for the support member, although the shape illustrated has been found to be a preferable one. The support member 26 may be constructed of wood, plastic, or of any other suitable floatable material.

With continued reference to FIG. 2, the support member 26 is illustrated as having a central element 28, and opposed wing elements 30 and 32. When the support member 26 is floating in the water, the central element 28 and the wing elements 30 and 32 lie in a substantially horizontal plane over which portions of the person's body may be positioned (FIG. 1). Specifically, it is preferred that the wing element 32 be positioned beneath the thighs 36 of the person 22 and that the wing element 30 be positioned beneath the calves 34 of the person.

In accordance with the invention, a mast 38 is mounted on the support member 26 and extends upwardly from the upper surface of the support member between the legs of the person 22 when in use, as seen in FIG. 1. Again, with a view of FIG. 2, the central element 28 is provided with a bore 40 which is suitably positioned to receive a stud 42 which is integral and coaxial with the mast 38 and extends from its base. The parts are arranged in such a manner that when the stud 42 is received through the bore 40, the extreme end extends beyond the lower surface of the support member 26 enabling a fastener such as wing nut 44 to be threadedly engaged with the stud. In this manner, the mast 38 can be securely mounted on the support member 26 so as to extend upwardly from the support member in a substantially perpendicular fashion.

A sail 46, preferably composed of nylon or other suitable lightweight material, is illustrated (see FIGS. 1 and 3) having a head 48, a tack 50, and a clew 52. As particularly well see in FIG. 4, a grommet 54 is secured in each such extreme corner of the sail 46, that is, at the extremity, respectively, of the head 48, the tack 50 and the clew 52. FIGS. 1, 3 and 4 depict the sail 46 as being reinforced around its periphery and, specifically, along the outer edge of its luff 56, its leach 58, and its foot 60. Reinforcing material 62 may be composed of wood, cloth, kapok, or other suitable buoyant material which may be sewn into the sail 46 or it may be attached in some other appropriate fashion.

The sail 46 is releasably attached to the mast 38 at spaced apart locations, and is movable in azimuth at the clew 52 by the person 22 about an axis defined by the mast to appropriate positions to catch the wind. To this end, viewing FIG. 1, it is seen that a pair of bores 64 and 66 are formed in the mast 38 at spaced apart locations. The bore 64 is located near the top of the mast and the bore 66 is located near the bottom of the mast or nearest the support member 26. A lightweight rope 68 is threaded through the grommet 54 at the head 48 of the sail 46 and is likewise threaded through the bore 64 of the mast 38. The rope 68 is then tied thereby securing the head 48 of the sail 46 to the mast 38. In a similar fashion, a lightweight rope 70 is threaded through the grommet 54 at the tack 50 of the sail 46 and through the bore 66 of the mast 38 and subsequently tied to secure the tack 50 to the lower portions of the mast. It will be appreciated that in place of the ropes 68 and 70, hooks or rings or other suitable devices may be utilized to releasably attach the sail 46 to the mast 38.

Additionally, in order to accommodate sails 46 of different sizes in accordance with the size of the person 22 using the invention, each of the intermediate segments 38*b*, 38*c*, and 38*d* (FIG. 1) is provided with a diametrical bore 71*b*, 71*c*, and 71*d*, respectively. These bores are similar to bores 64 and 66 and likewise serve to receive the ropes 68 and 70 for attaching sails of various sizes to the mast 38.

Still another lightweight rope 72 is shown threaded through the grommet 54 at the clew 52 of the sail 46 and securedly tied midway between its ends to the grommet 54 so that equal lenghts of the rope extend from opposite sides of the sail. The free ends of the rope 72 may be knotted as at 73 as a further aid for the person to grasp and hold them and thus serve to enable the person 22 to move the sail in azimuth relative to the mast.

In operation, the person 22 merely floats on her back as shown in FIG. 1 and places the sailing device 20 relative to her body so that the support member 26 is beneath her legs with the wing element 30 beneath her calves 34 and the wing element 32 beneath her thighs 36. In this position, the mast 38 extends upwardly between her legs. With the sail 46 fastened to the mast 38, the person takes hold of the respective ends of the rope 72 in her left and right hands, the clew 52 of the sail being closer to her head than the tack 50. By moving the sail about the mast 38 by means of the rope 72, the person can control the amount of wind caught by the sail 46 much in the manner of a customary sailboat. Steering can be performed by the person's hand which is free from the rope 72 at any given moment. Her steering hand would act much in the same manner as a rudder.

After use, whenever it is desired to store or transport the sailing device 20, the mast 38 can be collapsed from the extended position of FIG. 1 to the retracted position of FIG. 6. To this end, the mast 38 includes a plurality of interconnected hollow segments denoted, respectively, 38*a*, 38*b*, 38*c*, 38*d*, 38*e*, and 38*f*.

Each successive segment is capable of nesting within its larger neighboring segment and resilient detent devices 74 are associated with each pair of adjacent segments for maintaining its associated segments in an extended relationship. By reason of this construction, and with the aid of a knob 75 at the extremity of segment 38*a*, the mast 38 is movable between a fully extended position in which each adjacent pair of neighboring segments assumes an extended relationship, and a fully retracted position in which each segment is nested within its larger neighboring segment. The former condition is illustrated in FIG. 1 and the latter condition is illustrated in FIG. 6.

In a similar fashion, the support member 26 is capable of being folded and, to this end, includes a pair of hinges 76 and 78 which foldably connect, respectively, the central element 28 to the wing elements 30 and 32. Thus, at the appropriate time, the wing elements 30 and 32 can be folded relative to the central element 28 from the planar position illustrated in FIG. 2 to the folded position illustrated in FIG. 6.

For ease of carrying the sailing device 20 when it is in the folded position (FIG. 6), a pair of straps or handles 80 of any suitable material are fixed to the extreme edges of the wing elements 30 and 32 respectively.

The invention, in its broader aspects, is not limited to the specific details shown and described, and departures may be made from such details without departing from the principles of the invention, and without sacrificing its chief advantages.

What is claimed is:

1. Apparatus for propelling the body of a person floating in the water comprising:

a floatable support member having a substantially continuous planar surface over which the person's legs are positioned in the water and having a centrally located bore extending therethrough;

a mast releasably mounted on said member and extending upwardly from said planar surface between the person's legs and achieving a normally upright relationship with the surface of the water only when the person's legs are positioned upon said planar surface, said mast being collapsible and including a plurality of interconnected hollow segments, each successive segment capable of nesting within its larger neighboring segment, and resilient detent means associated with each pair of adjacent segments for maintaining said pair in an extended relationship such that said mast is movable between a fully extended position in which each adjacent pair of neighboring segments assumes an extended relationship, and a fully retracted position in which each segment is nested within its larger neighboring segment, each successive segment further having a pair of holes at diametrically opposite positions;

means mounting said mast on said support member including a stud integral and coaxial with said mast and extending from the base thereof, said stud receivable in and through the bore in said support member, and a fastener threadedly engageable with said stud;

a sail having a head, a tack, and a clew, said head and said tack releasably attached to said mast at spaced apart locations, respectively, and movable in azimuth adjacent the clew by the person about an axis defined by said mast to appropriate positions to catch the wind;

fasteners attached to said sail at said head and said tack and receivable through the pair of holes of said segments at spaced apart locations to thereby releasably attach said sail to said mast; and control means attached to said clew for aiding the person in moving said sail in azimuth relative to said mast.

2. Apparatus as set forth in claim 1 wherein said support member comprises at least two elements and is foldable and including hinges mounted on each of said elements and connecting said elements enabling relative movement of said elements between an open position and a folded position.

3. Apparatus as set forth in claim 2 including handles for carrying said apparatus when said support member is in the folded position.

* * * * *